US005675243A

United States Patent [19]

Kamata

[11] Patent Number: 5,675,243

[45] Date of Patent: Oct. 7, 1997

[54] VOLTAGE SOURCE DEVICE FOR LOW-VOLTAGE OPERATION

[75] Inventor: Takatsugu Kamata, Sendai, Japan

[73] Assignee: Motorola, Inc., Schaumburg, Ill.

[21] Appl. No.: 630,151

[22] Filed: Apr. 10, 1996

[30] Foreign Application Priority Data

May 31, 1995 [JP] Japan ..... 7-158466

[51] Int. Cl.[6] ..... G05F 3/16

[52] U.S. Cl. ..... 323/313; 323/315; 323/907

[58] Field of Search ..... 323/312, 313, 323/314, 315, 907; 363/73; 327/538, 542, 543

[56] References Cited

U.S. PATENT DOCUMENTS

| | | | |
|---|---|---|---|
| 4,004,247 | 1/1977 | Van De Plassche | 330/30 D |
| 4,370,608 | 1/1983 | Nagano et al. | 323/316 |
| 4,467,289 | 8/1984 | Okada | 330/288 |
| 5,430,367 | 7/1995 | Whitlock et al. | 323/313 |
| 5,512,816 | 4/1996 | Lambert | 323/315 |

OTHER PUBLICATIONS

IEEE Journal of Solid–State Circuits, vol. 28, No. 6, Jun. 1993, pp. 667–670.

*Primary Examiner*—Adolf Berhane

*Attorney, Agent, or Firm*—Harry A. Wolin; Robert D. Atkins; Rennie William Dover

[57] ABSTRACT

A voltage source device for low-voltage operation which sources a desired voltage while minimizing variations in output voltage due to changes in temperature. The voltage source device includes a current source circuit having a temperature characteristic of (1/T)-a and a compensation circuit having a temperature characteristic that includes a term of −1/T, which compensates for the temperature characteristic of the current source circuit. The voltage source device also includes a voltage conversion circuit for converting the power supply current provided by the current source circuit into a power supply voltage and outputting it externally.

3 Claims, 7 Drawing Sheets

VOLTAGE SOURCE DEVICE FOR LOW-VOLTAGE OPERATION

1. Field of the Invention

The present invention relates to a voltage source device for low-voltage operation, which involves minimum output fluctuations relative to outer temperatures (ambient temperatures).

2. Background of the Invention

Conventionally, a bandgap-based voltage source device is available as shown in FIG. 7, as a voltage source device for generating a reference voltage to compare a field strength of a received signal against a reference voltage value in a portable radio, such as cordless telephone, for example.

This voltage source device is comprised of bipolar transistors q1, q2, resistors Ra, Rb, r1, r2, and a differential amplifier A1, wherein the output voltage from the differential amplifier A1 is fed back to the bases of the bipolar transistors q1, q2, thereby producing a constant voltage.

However, with a conventional bandgap-based voltage source device, it is necessary, because of its intended purpose, to supply a stable voltage relative to changes in ambient temperature; however, device characteristics of the bipolar transistors q1, q2, resistors Ra, Rb, r1, r2, and differential amplifier A1 vary with changes in temperature. Assuming that the horizontal and vertical axes are temperature (T) and voltage (V), respectively, the output voltage provided by this voltage source device exhibits a dome-shaped output characteristic as shown in FIG. 8, so there is a problem that it is difficult to eliminate from the voltage source device variations in output voltage associated with changes in temperature.

Also, the output voltage of the bandgap-based voltage source device is typically about 1.2 V; to produce a desired low voltage, it is necessary to add another circuit, such as by dividing the voltage through resistor(s), resulting in more circuit elements for implementing a voltage source device that outputs a desired voltage.

Accordingly, it is an object of the present invention to provide a voltage source device for low-voltage operation, which can produce a desired voltage, while minimizing variations in output voltage due to changes in temperature.

SUMMARY OF THE INVENTION

According to the present invention, a voltage source device comprises: a current source circuit using a bandgap voltage, said current source circuit having a temperature characteristic of 1/T-a (where T is an ambient temperature, and a is a constant); a compensation circuit, having a temperature characteristic including at least a term of −1/T, said compensation circuit compensating for the temperature characteristic of said current source circuit; and a voltage conversion circuit for converting the power supply current provided by said current source circuit into a power supply voltage and outputting it externally.

In this case, the compensation circuit comprises first and second compensation circuits, wherein said first compensation circuit includes: a pair of first and second transistors having collector terminals connected to a high potential power supply line, emitter terminals connected to a low-potential power supply line, and base terminals connected in common; a third transistor having a base terminal connected to the collector terminal of said first transistor, a collector terminal connected to the collector terminal of said second transistor, and an emitter terminal connected to the base terminals of said first and second transistors connected in common; and a resistor having one end connected to the base terminals of said first and second transistors connected in common, and the other end connected to the low-potential power supply line.

Furthermore, the second compensation circuit includes: a resistor having one end connected to the base terminals of said first and second transistors connected in common; a fourth transistor having its base and collector terminals connected to the other end of said resistor, and an emitter terminal connected to the low-potential power supply line; and a current supply circuit for supplying a predetermined constant current to the base and collector terminals of said fourth transistor.

The bandgap-based voltage source circuit has a temperature characteristic of 1/T-a (where T is an ambient temperature, and a is a constant). In addition, the compensation circuit has a temperature characteristic including at least a term of −1/T, and by adding this current to the current supplied by the current source circuit, the term 1/T of the current sourced from the current source circuit into the voltage conversion circuit is reduced to approximately zero.

Here, when the compensation circuit is implemented according to claim 2, the current including terms 1/T and 1nT flows through the compensation circuit, as detailed in the first embodiment described later. As a result, because the term −1/T is eliminated, though the term 1nT remains in the temperature characteristic of the current sourced into the voltage conversion circuit, a stable output voltage is obtained relative to changes in temperature.

When the first and second compensation circuits are implemented according to claim 3, the current including terms −1/T and 1nT flows through the first and second compensation circuits, as detailed in the second embodiment described later. As a result, because the term including T is eliminated from the temperature characteristic of the current sourced into the voltage conversion circuit, a very stable output voltage is obtained relative to changes in temperature.

DETAILED DESCRIPTION OF THE DRAWINGS

One preferred embodiment of the present invention is described below with reference to the accompanying drawings.

Figure 1:
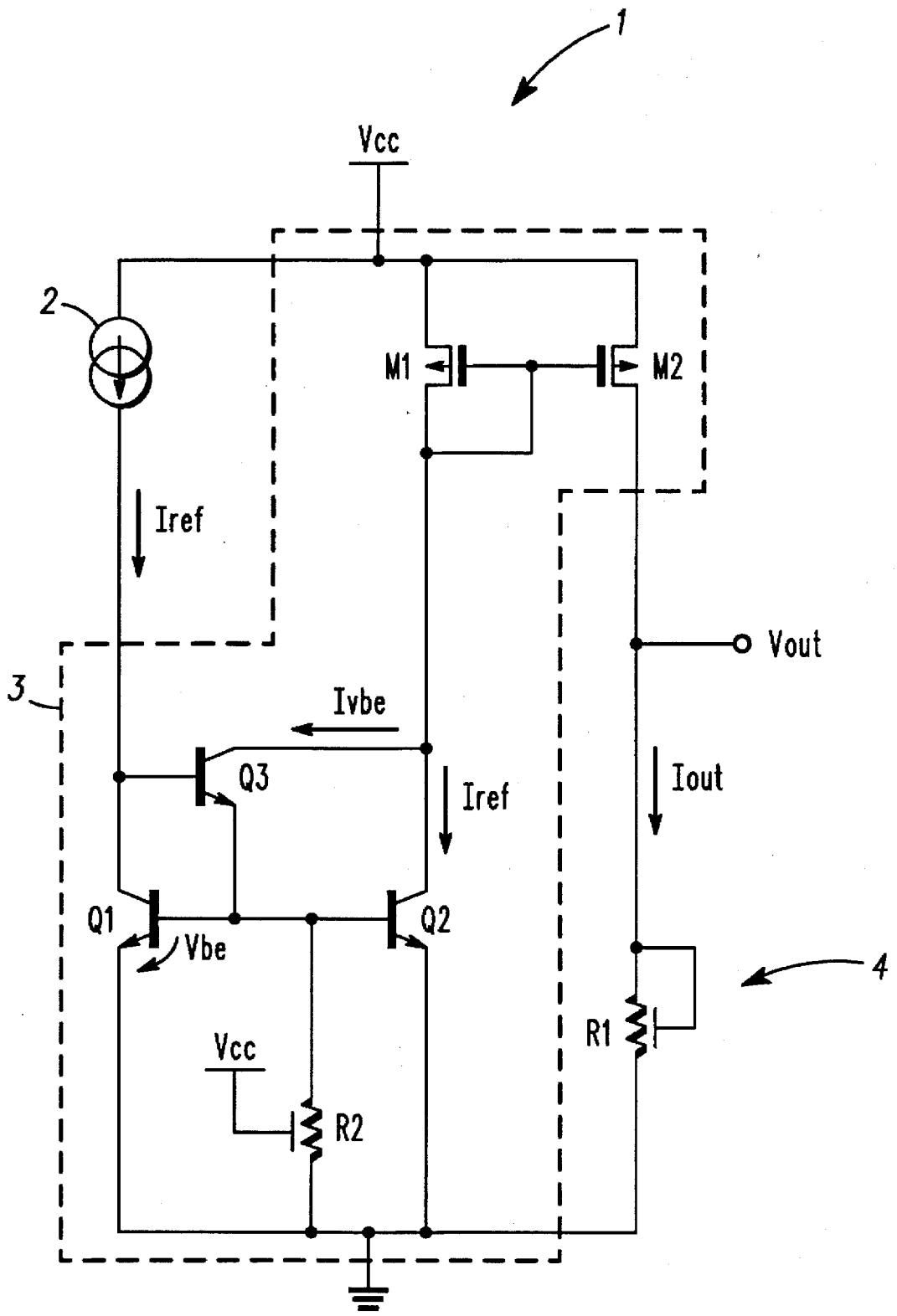
FIG. 1 is a circuit diagram of a power source device according to one embodiment of the invention.

FIG. 1 is a circuit diagram of a power source device 1 according to the first embodiment of the present invention.

As shown in FIG. 1, the voltage source device 1 according to the present embodiment is mainly comprised of a current source circuit 2, a compensation circuit 3, and a voltage conversion circuit 4.

The current source circuit 2 is a bandgap-based current source for conducting a current having a temperature characteristic of 1/T-a (where T is an ambient temperature and a is a constant) through the compensation circuit 3; the voltage conversion circuit 4 comprises a resistor R1.

The compensation circuit 3 is comprised of a bipolar transistor Q1 as a first transistor, a bipolar transistor Q2 as a second transistor, a bipolar transistor Q3 as a third transistor, a resistor R2, and MOS transistors M1 and M2, so that it has an inverted temperature characteristic of the current source circuit 2, i.e., −1/T.

More specifically, the bipolar transistors Q1 and Q2 form a current mirror circuit, where the base terminals of the transistors Q1 and Q2 are connected in common, the collector terminal of the transistor Q1 is connected to the current source circuit 2, and the emitter terminal of the transistor Q1 is connected to ground; on the other hand, the collector terminal of the transistor Q2 is connected to the common gate terminal of the MOS transistors M1 and M2, and the emitter of the transistor Q2 is connected to ground.

The transistor Q3 has its base terminal connected to the collector terminal of the transistor Q1, its collector terminal connected to the collector terminal of the transistor Q2, and its emitter terminal connected to the common base terminal of the transistors Q1 and Q2. The resistor R2 has its one end connected to the common base terminal of the transistors Q1 and Q2, and its other end connected to ground.

The MOS transistors M1 and M2 are formed so that their size ratio is 2:1; their base terminals are connected in common, and their source terminals are connected to a high-potential power supply Vcc; the drain terminal of the MOS transistor M1 is connected to its base terminal, and the drain terminal of the MOS transistor M2 is connected to the output terminal Vout and to one end of the resistor R1.

Next, the example of operation of the first embodiment is described with reference to FIGS. 2 and 3.

Figure 2:
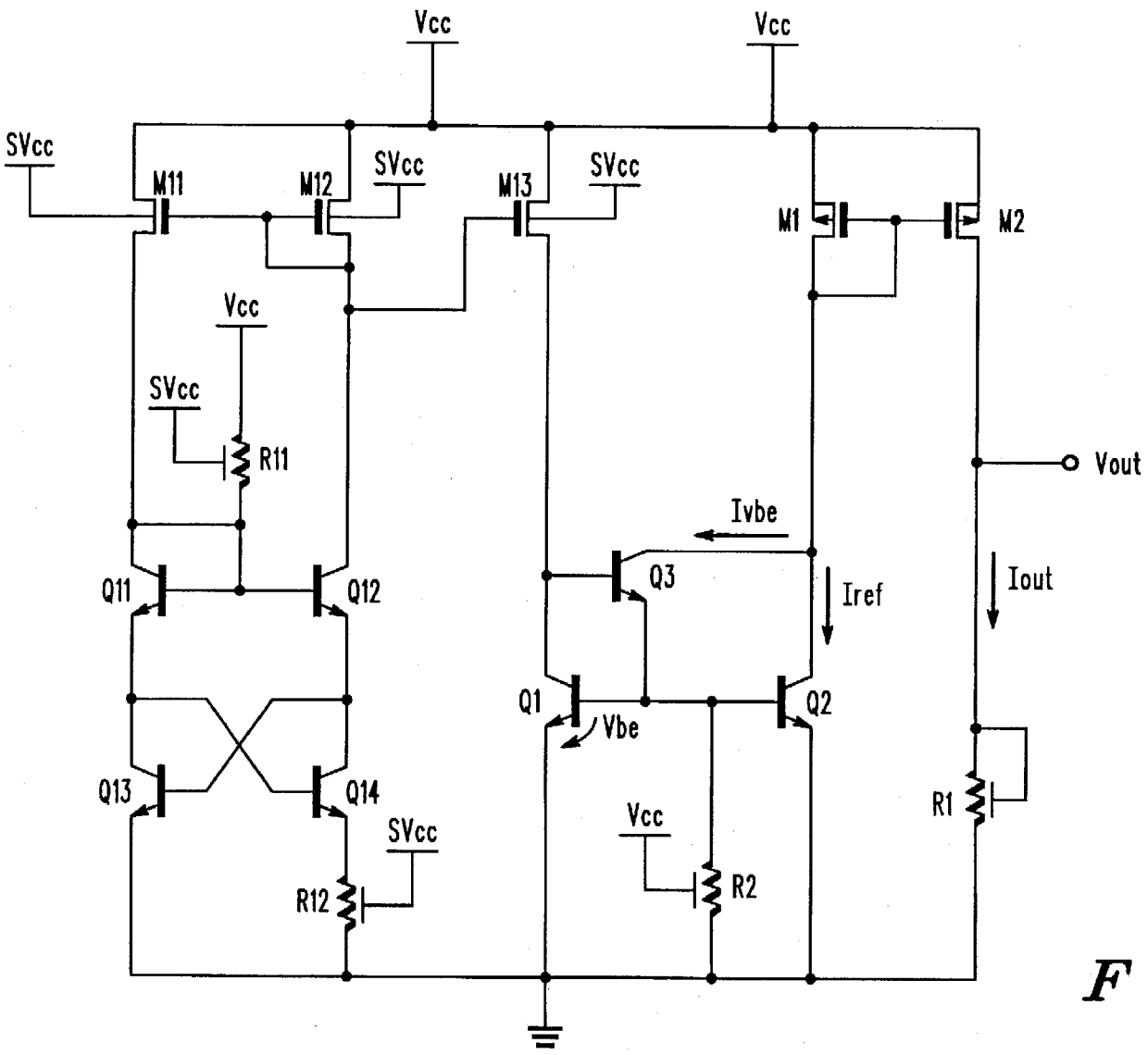
FIG. 2 is a circuit diagram prepared based on FIG. 1 for computer analysis.
Figure 3:
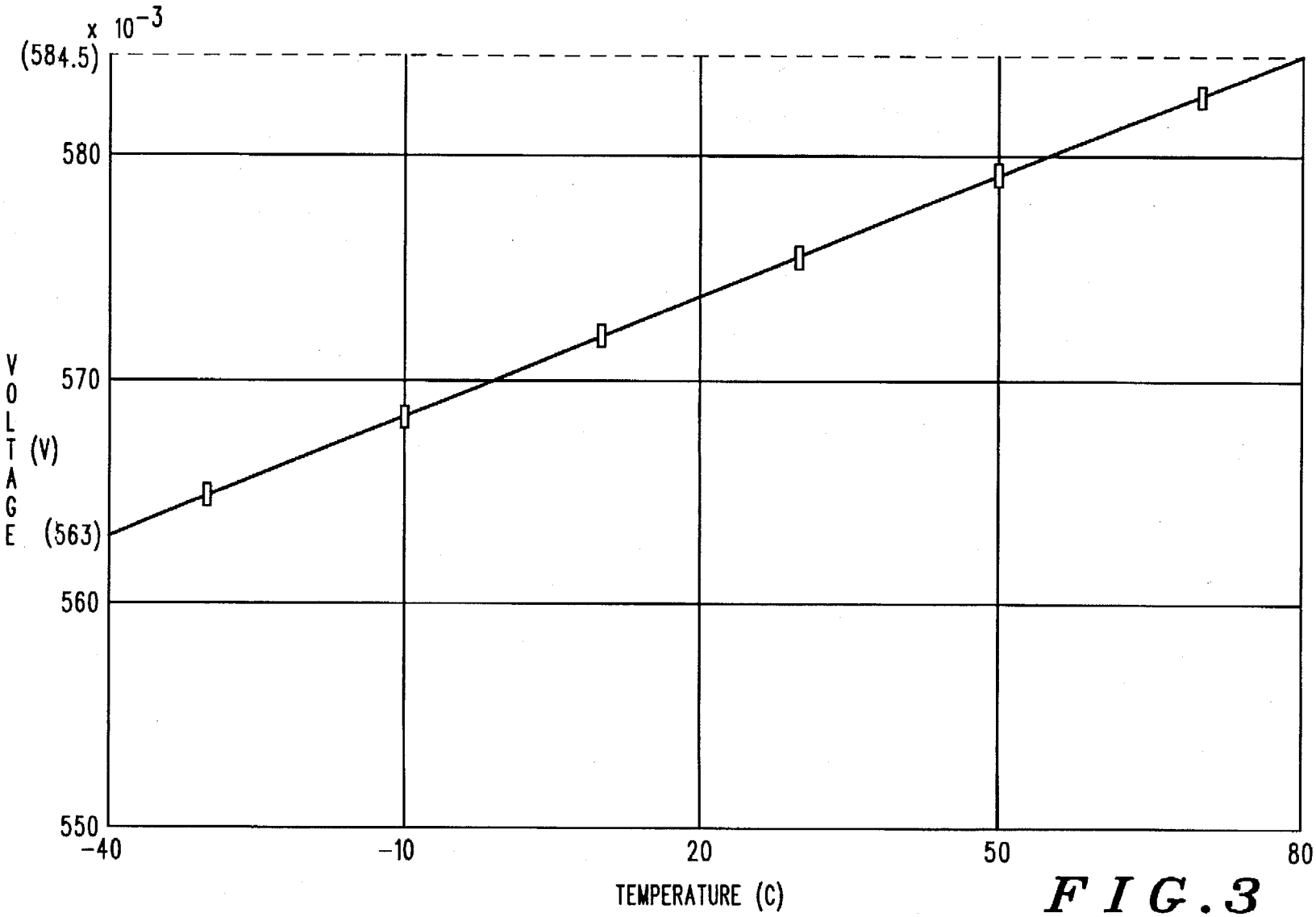
FIG. 3 shows the result of computer analysis using an arithmetic calculation program on the circuit shown in FIG. 2.

FIG. 2 is a circuit diagram prepared based on FIG. 1 for computer analysis, and FIG. 3 is a diagram showing the result of computer analysis using an arithmetic calculation program on the circuit shown in FIG. 2, where the current source circuit 2 in FIG. 1 is comprised of bipolar transistors Q11–Q14, MOS transistors M11–M13, and resistors R11 and R12.

Now, assuming that the ambient temperature (in K) is T; the saturation current of transistor Q1 at temperature T is Is(T); the reference temperature (in this case, 300K=27° C.) is Tref; the saturation current with T=Tr is Is; the saturation current temperature coefficient (in this case, 3) is XTI; the energy gap (its value is 1.0818 [eV]) at Tr is Eg(Tr); and the thermal voltage at temperature T is Vt(T), and that exp is abbreviated as e, then the saturation current Is(T) of a transistor is given by the following equation in a non-saturation area $$Is(T) = Is*\left(\frac{T}{Tr}\right)^{XTI}*e*\left\{-\frac{Eg(Tr)}{Vt(T)}*\left(1-\frac{T}{Tr}\right)\right\} \quad \text{[Equation 1]}$$

The base-emitter voltage Vbe of the transistor Q1 is similarly expressed as follows in the non-saturation area:

$$Vbe(T) = Vt(T)*\ln\frac{I}{Is(T)} = Vt(T)*(\ln I - \ln Is(T)) \quad \text{[Equation 2]}$$

where I is the emitter current flowing through the transistor at a temperature of Tr. Vt(T) is given by:

$$Vt(T) = \frac{T}{Tr}*Vt(Tr) \quad \text{[Equation 3]}$$

lnIs(T) is expressed as follows, based on Equation 1:

$$\ln Is(T) = \ln Is + XTI*\ln\left(\frac{T}{Tr}\right) - \frac{Eg(Tr)}{Vt(T)}*\left(1-\frac{T}{Tr}\right) \quad \text{[Equation 4]}$$

Vbe(T) is expressed as follows, based on Equations 2, 3, and 4:

$$\begin{aligned} Vbe(T) &= Vt(T)*\ln(I/Is) - Vt(T)*XTI*\ln(T/Tr) + Eg(Tr)*\left(1-\frac{T}{Tr}\right) \\ &= (T/Tr)*Vbe(Tr) - Vt(T)*XTI*\ln\left(\frac{T}{Tr}\right) + Eg(Tr)*\left(1-\frac{T}{Tr}\right) \\ &= Eg(Tr) - \left(\frac{T}{Tr}\right)*(Eg(Tr) - Vbe(Tr)) - Vt(T)*XTI*\ln\left(\frac{T}{Tr}\right) \end{aligned} \quad \text{[Equation 5]}$$

Thus, Vbe(T) may be expressed as a function of temperature T, as follows:

$$Vbe(T) = Eg(Tr) - \frac{Eg(Tr) - Vbe(Tr)}{Tr}*T - Vt(T)*XTI*\ln\left(\frac{T}{Tr}\right) \quad \text{[Equation 6]}$$

The reference current Iref supplied from the current source circuit 2 is a thermal current produced by the bandgap, and its temperature coefficient is (1/T)-a [ppm/° C.] as described above (where a is a temperature coefficient of the diffused resistor); when 1/T>a, it has a positive temperature characteristic. Because the transistors Q1 and Q2 form a current mirror, the current Iref flows through the collector terminal of the transistor Q2, and the current Ivbe flowing through the resistor R2 flows through the transistor Q3. The current Ivbe has a negative temperature characteristic, represented by Vbe/R2.

Now, assume that the resistance R2 is determined so that the value of Ivbe is equal to Iref and that the size ratio of the MOS transistors M1 and M2 is 2:1. Then, the temperature characteristic of the output voltage Vout in FIG. 2 is represented by R1 x Iout, and the temperature coefficient of the output voltage Vout is given by:

$$\frac{1}{Vout}*\frac{d\,Vout}{dT} = a + \frac{1}{Iout}*\frac{d\,Iout}{dT}\ \text{[ppm/celsius]} \quad \text{[Equation 7]}$$

where Iout=b*(Iref+Ivbe)

(b is any value greater than 0 (b=½ in FIG. 2)

Then, if the temperature characteristic of Iref is:

$$\frac{d\,Iref}{dT} = \left(\frac{1}{T} - a\right)*Iref\ \text{[A/celsius]} \quad \text{[Equation 8]}$$

then the temperature characteristic of Ivbe is expressed as follows, based on Equation 6:

$$\frac{d\,Ivbe}{dT} = \frac{d}{dT}\left(\frac{Vbe}{R1}\right) = \frac{d}{dT}\left(\frac{Eq(Tr) - kT - Inl(T)}{R1}\right) = \frac{1}{R1^2}\left\{R1*\left(-k - \frac{d}{dT}\,Inl(T)\right) - \frac{dR1}{dT}*Vbe\right\} \quad \text{[Equation 9]}$$

where $k = \frac{Eg(Tr) - Vbe(Tr)}{Tr}$, $Inl(T) = Vt(T)*XTI*\ln\left(\frac{T}{Tr}\right)$ Because Inl(T) is very small as compared to other terms, omitting (d/dT) * Inl(T) yields:

$$\frac{d\,Ivbe}{dT} = -\frac{k}{R1} - a*Ivbe \quad \text{[A/celsius]} \quad \text{[Equation 10]}$$

From Equations 8 and 10, $$\frac{d\,Iout}{dT} = b\left(\frac{d\,Iref}{dT} + \frac{d\,Ivbe}{dT}\right) = b\left\{\left(\frac{1}{T} - a\right)*Iref - \frac{k}{R1} - a*Ivbe\right\} = b\left\{\frac{1}{T} - 2a\right)*Iref - \frac{k}{R1}\right\} \quad \text{[Equation 11]}$$

(where supposing Iref=Ivbe)
is determined, and based on this result, the following equation is obtained:

$$\frac{1}{Iout}*\frac{d\,Tout}{dT} = \frac{b*Iref}{Iout}\left(\frac{1}{T} - 2a\right) - \frac{b}{Iout}*\frac{k}{R1} = \frac{1}{2}\left(\frac{1}{T} - 2a\right) - \frac{1}{2*Iref}*\frac{k}{R1} \quad \text{[ppm/celsius]} \quad \text{[Equation 12]}$$

(where using Iout=2*b*Iref)
Then, after substituting Equation 7 into Equation 12, the condition for the resulting value, i.e., the temperature coefficient of Vout, being zero (exactly speaking, it is not zero because Inl(T) is approximated as zero) is that the following equation holds true:

$$a + \frac{1}{2}\left(\frac{1}{T} - 2a\right) - \frac{1}{2*Iref}*\frac{k}{R1} = 0 \quad \text{[Equation 13]}$$

$$\frac{1}{2}*\frac{1}{T} - \frac{1}{2*Iref}*\frac{k}{R1} = 0$$

$$k = Iref*R1*\frac{1}{T} = \frac{Eg(Tr) - Vbe(Tr)}{Tr}$$

$$Vbe(Tr) = Eg(Tr) - \frac{Tr}{T}*Iref*R1 = Eg(Tr) - Iref*R1$$

(where assuming T=Tr)
That is, if the value of k determined from the first line of Equation 13 is assumed to be equal to the value of k defined in Equation 9, then Vbe (Tr)=Eg (Tr)–Iref * R1; thus, the temperature coefficient of Vout is reduced to zero by defining the resistance R2 so that Ivbe=Iref, as described above, and by determining the circuit constant so that the above equation holds true with respect to Vbe (Tr).

In this way, the present embodiment works to compensate for the term {Eg (Tr)–Vbe (Tr)} * T/Tr in Equation 6, thereby bringing the temperature characteristic of the output voltage Vout of the voltage source device for low-voltage operation close to zero.

Thus, as shown in FIG. 3, the value of the voltage Vout is within 21.5 mV relative to a temperature ranging from –40° C. to +80° C., so it can be seen that a voltage source device for low-voltage operation can be implemented with a high degree of accuracy held within 3.78%.

Figure 4:
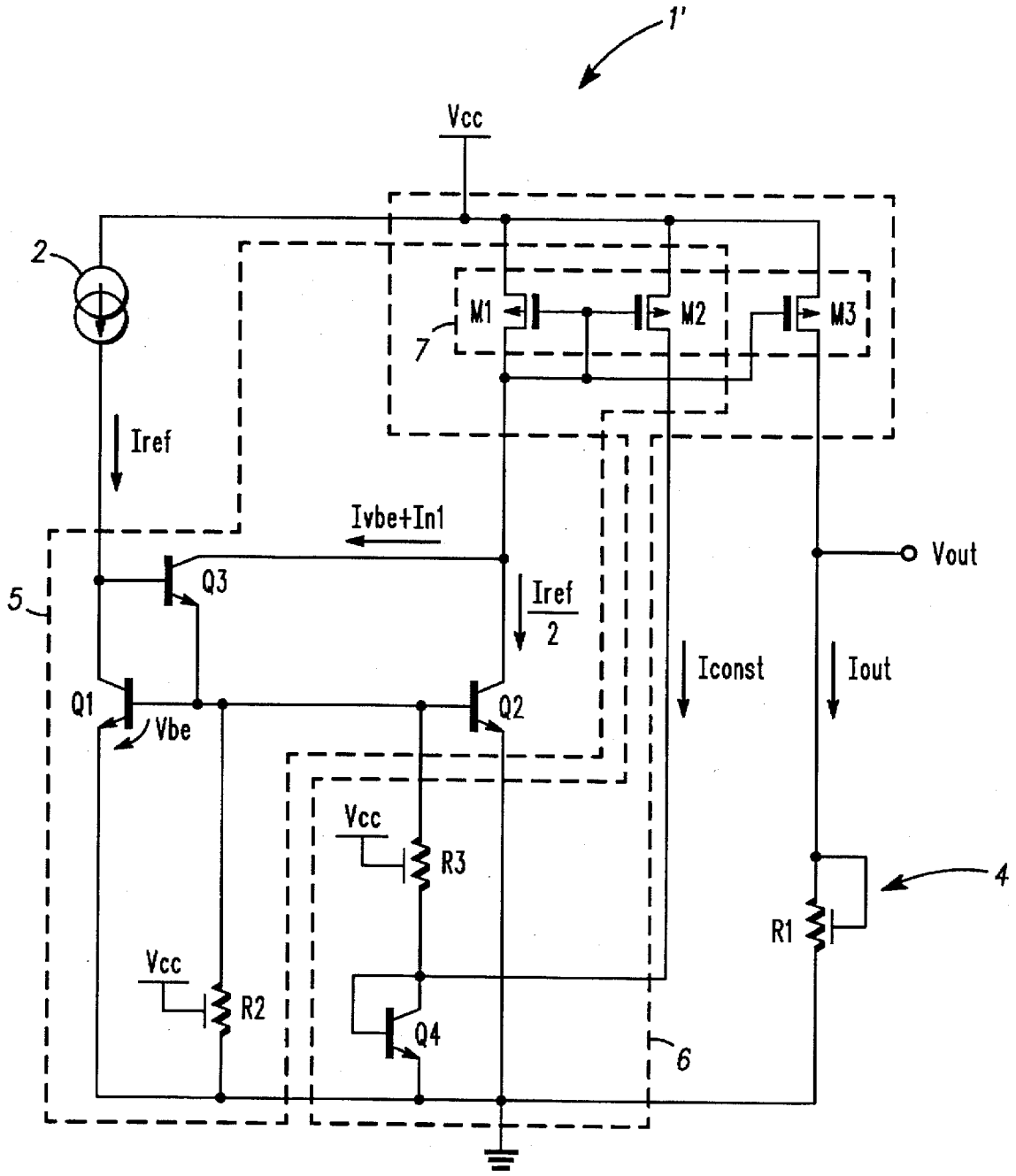
FIG. 4 is a circuit diagram of a voltage source device according to a second embodiment of the invention.

FIG. 4 is a circuit diagram of a voltage source device 1' according to a second embodiment. In FIG. 4, like parts of FIG. 1 are denoted by the same reference symbol.

The voltage source device 1' of the present embodiment includes a second compensation circuit 6, in addition to a first compensation circuit 5 that is the same as the compensation circuit 3 of the first embodiment described above.

The second compensation circuit 6 is comprised of a bipolar transistor Q4 as a fourth transistor, MOS transistors M1–M3 that form a current supply circuit 7, and a resistor R3.

The bipolar transistor Q4 has its base and collector terminals connected to one end of the resistor R3, and its emitter terminal connected to ground, while the other end of the resistor R3 is connected to the common base terminal of the transistors Q1 and Q2.

The MOS transistors M1–M3 are formed so that their size ratio is 2:4:1, and their base terminals are connected in common, and their source terminals are connected to a high-potential power supply Vcc; the drain terminals of the MOS transistors M1 and M2 are connected to the base terminal, and the drain terminal of the MOS transistor M3 is connected to the output terminal Vout and to one end of the resistor R1.

Next, an example of operation of the second embodiment is described with reference to FIGS. 5 and 6.

Figure 5:
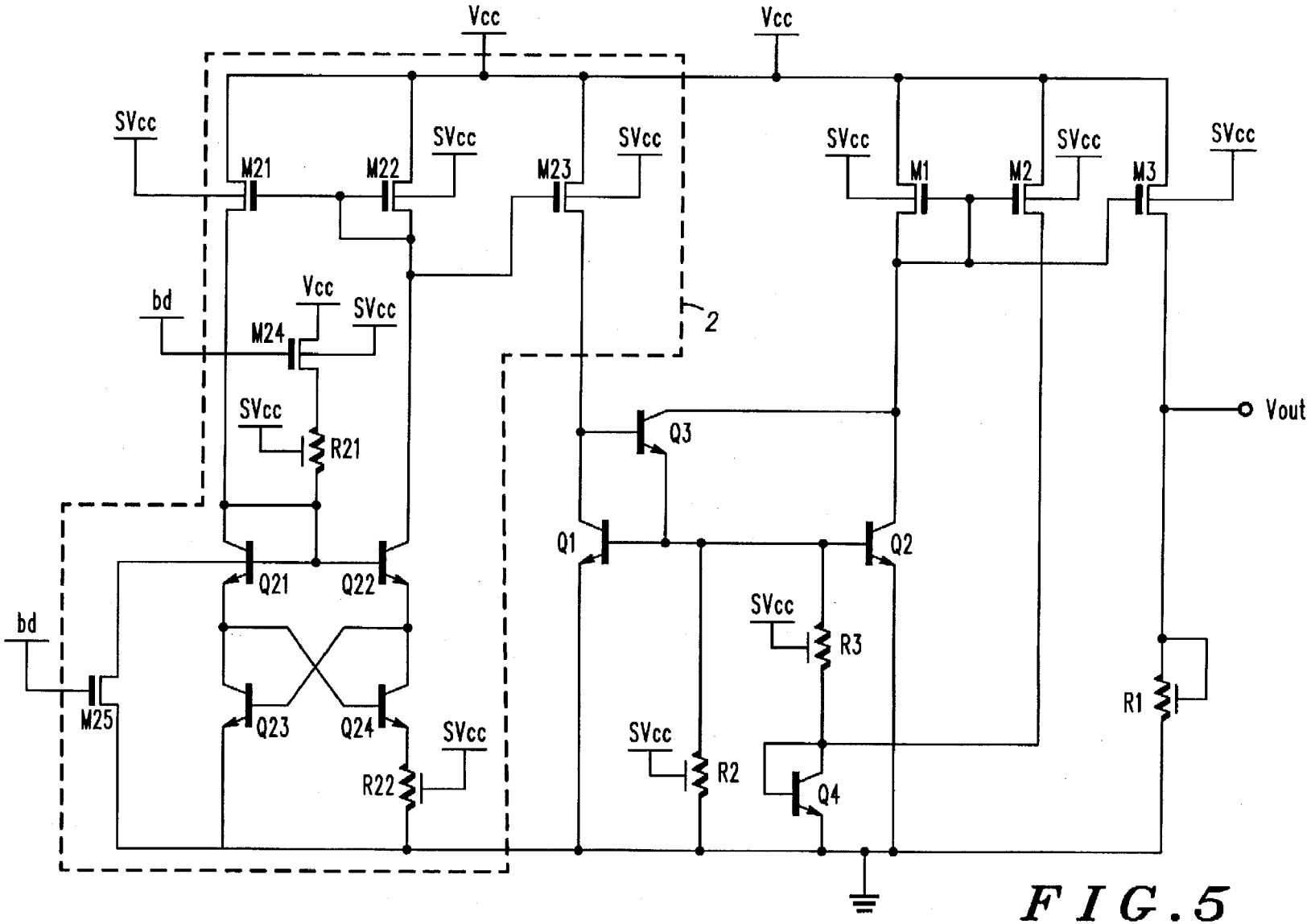
FIG. 5 is a circuit diagram prepared based on FIG. 4 for computer analysis.
Figure 6:
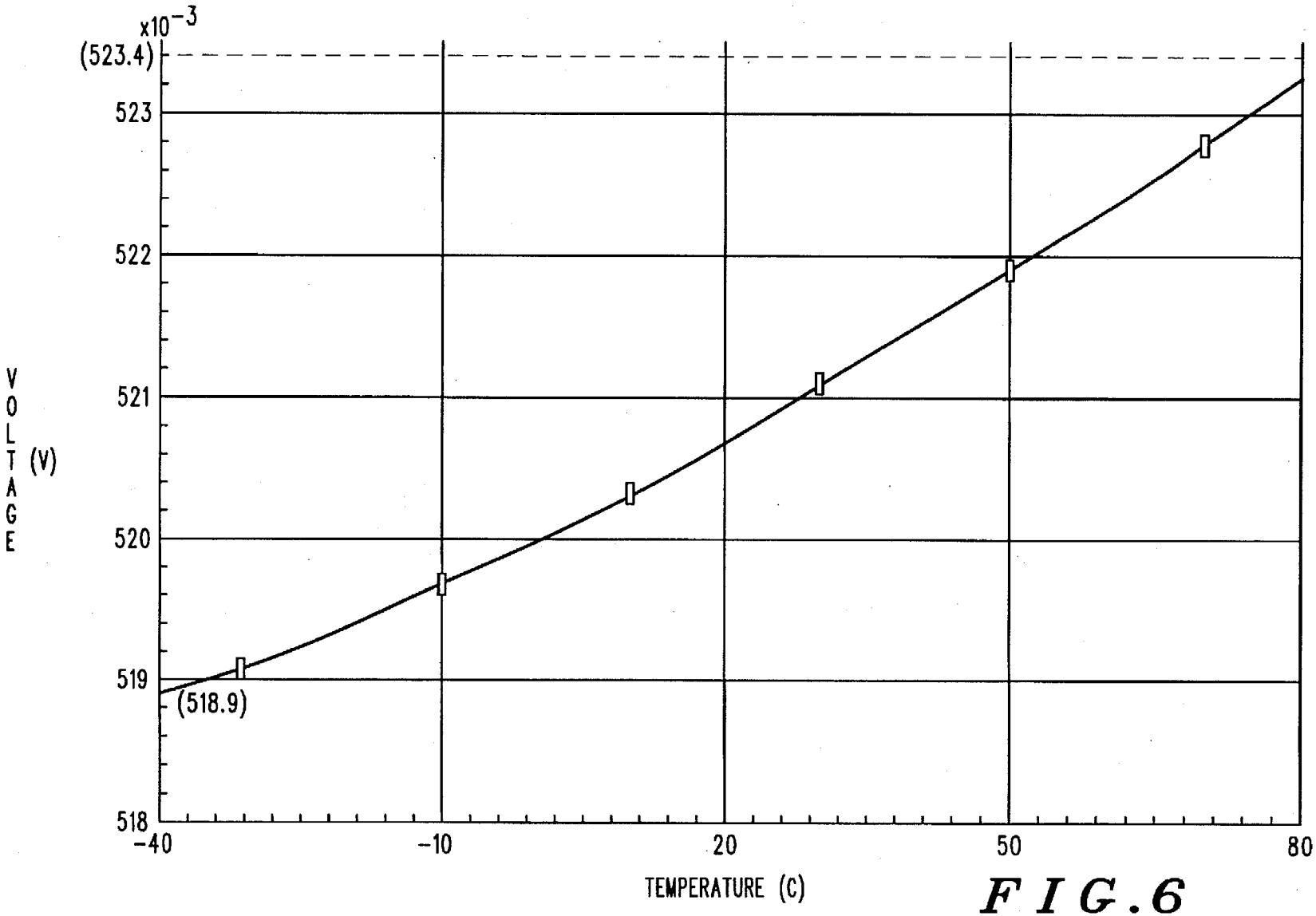
FIG. 6 shows the result of computer analysis using an arithmetic calculation program on the circuit shown in FIG. 5.
Figure 7:
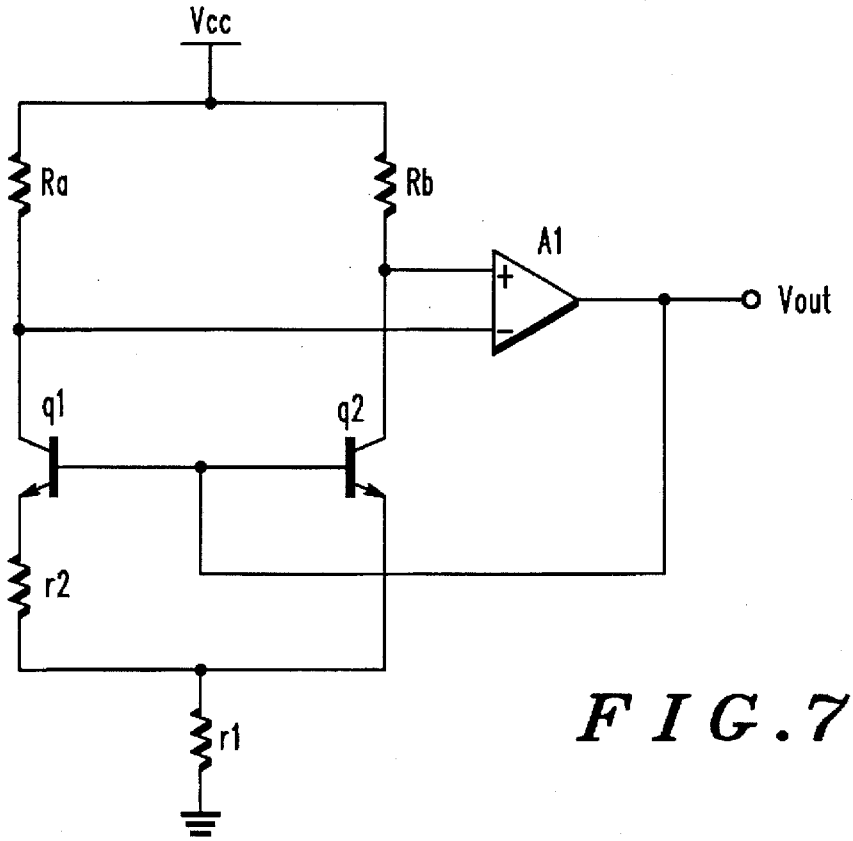
FIG. 7 is a circuit diagram of a prior art voltage source device using a bandgap.
Figure 8:
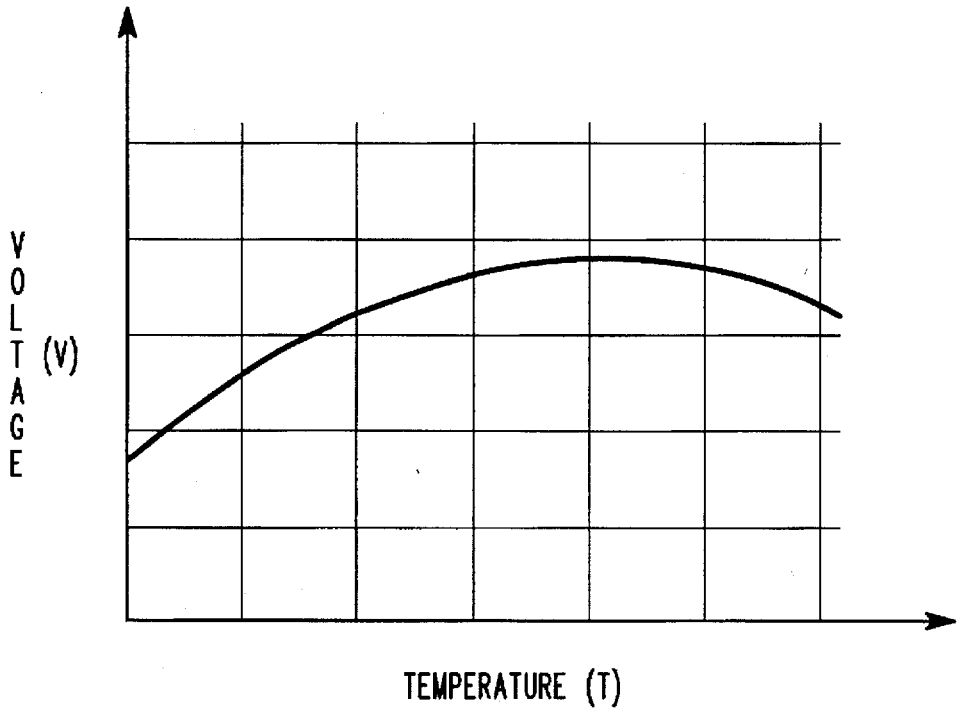
FIG. 8 shows variations in output voltage of the prior art voltage source device relative to temperature changes.

FIG. 5 is a circuit diagram prepared based on FIG. 4 for computer analysis, and FIG. 6 is a diagram showing the result of computer analysis using an arithmetic calculation program on the circuit shown in FIG. 5, where the current source circuit 2 in FIG. 4 is comprised of bipolar transistors Q21–Q24, MOS transistors M21–M25, and resistors R21 and R22.

In the above first embodiment, because the temperature characteristic of Vbe has a nonlinear portion (i.e., the term Vt (T) * XTI * in (T/Tr) in Equation 6) (in Equation 9, it is calculated on the assumption that Inl (T) /dT is zero), the temperature characteristic could not be reduced to completely zero; however, the present embodiment reduces this nonlinear portion to zero, thereby providing a voltage source device 1' with a superior temperature characteristic.

In consideration of FIG. 4, the current Inl is expressed as follows:

$$Inl = \frac{Vt(T)}{R3}*\ln\left(\frac{N*Iref}{Iconst}\right) \quad \text{[Equation 14]}$$

where Inl is added as the current flowing through the resistor R3, for the sake of calculation.

Now, assuming that Iconst=2 (Ivbe+Inl)+Iref=2 * Ivbe+2 * Inl+Iref, then 2 * Ivbe is expressed as follows, based on Equation 6:

$$2*Ivbe = 2*\frac{Vbe}{R2} = \frac{2*Eg(Tr)}{R2} - 2*\frac{Eg(T)-Vbe(Tr)}{R2*Tr}*T - 2*\frac{Vt(T)}{R2}*XTI*\ln\left(\frac{T}{Tr}\right) \quad \text{[Equation 15]}$$

Meanwhile, 2 * Inl is expressed as follows, based on Equation 14:

$$2*Inl = 2*\frac{Vt(T)}{R3}*\ln\left(\frac{N*Iref}{Iconst}\right) \quad \text{[Equation 16]}$$

Then, Iref may be given, as one example, by the following equation, in consideration of the bandgap in FIG. 5:

$$Iref = \frac{Vt(T)}{R}*\ln 49 = \frac{Vt(Tr)}{R*Tr}*T*\ln 49 \quad \text{[Equation 17]}$$

(where R is a resistance value used in the circuit)

Now, assuming that for the term 2 * {VT (T)/R2} * XTI * ln (T/Tr) in Equation 15 and the term 2 * (VT (T)/R3) * ln (N * Iref/Iconst) in Equation 17, the term ln for both is nearly equal as Iconst N * Iref so that it is R3/R2 XTI, then the term 2 * (VT (T)/R2) * XTI * ln (T/Tr) in the above Equation 15 and the term 2 * (Vt (T)/R3) * ln (N * Iref/Iconst) in the above Equation 17 can be eliminated.

Also, for the term 2 * {(Eg (Tr)−Vbe (Tr))/(R 2 * Tr)} * T in Equation 15 and the term (Vt (Tr)/R * Tr) T * ln49 in Equation 17, assuming that:

$$\frac{R}{R2} = \frac{Vt(Tr)*\ln 49}{2(Eg(Tr)-Vbe(Tr))} \quad \text{[Equation 18]}$$

then the term 2 * {(Eg (Tr)−Vbe (Tr))/(R 2 * Tr)} in the above Equation 15 and the term Vt (Tr)/R * Tr) T * ln49 in Equation 17 can also be eliminated similarly.

Thus, Iconst may be expressed as:

$$Iconst = 2*\frac{Eg(Tr)}{R2} \quad \text{[Equation 19]}$$

So, Vout is given by:

$$Vout = \frac{Iconst}{4}*R1 = \frac{R1}{2*R2}*Eg(Tr)$$

$$\frac{R}{R2} = \frac{Vt(T)*\ln 49}{2(Eg(Tr)-Vbe(Tr))}$$

$$\text{where } Inconst = N*Iref, \frac{R3}{R2} = XTI \quad \text{[Equation 20]}$$

Thus, the nonlinear portion is removed, so that the output voltage Vout is immune to the influence of temperature.

That is, the reference current Iref supplied from the current source circuit 2 is a thermal current produced by the bandgap, and its temperature coefficient is (1/T)—a [ppm/°C.] (where a is a temperature coefficient of the diffused resistor); when 1/T>a, it has a positive temperature characteristic. In addition, the bipolar transistors Q1 and Q2 form a current mirror, so a current Iref/2 flows through the collector terminal of the bipolar transistor Q2.

Then, a sum of the current Ivbe flowing through the resistor R1 and the current Inl induced by the nonlinear portion of the base-emitter voltage Vbe of the bipolar transistor Q1 flows through the bipolar transistor Q3. The current Ivbe has a negative temperature characteristic represented by Vbeal/R1.

Now, let us assume that the resistance R1 is determined so that the value of Ivbe is equal to Iref; the size ratio of the P-channel MOS transistors M1 and M2 is 1:2; and the current Iconst flowing through the transistor Q4 is Iref+2×(Ivbe+Inl). Additionally, assuming that the size of the transistor Q4 is three times the size of the transistor Q1, then Inl is nearly zero. Thus, these are set at room temperature, and consider cases where the temperature rises and falls, respectively.

(When the temperature rises)

For the term ln (T/Tr) in the above Equation 6, in (T/Tr)>0 because T/Tr>1; so the gradient of Vbe relative to changes in temperature becomes sharp, so Ivbe is reduced accordingly. Correspondingly, Iconst and the transistor Q4's Vbe are reduced; and a voltage drop occurs across the resistor R2 corresponding to a difference between Vbe of the transistor Q1 and Vbe of the transistor Q2, and flows into the resistor R2 as Inl. Then, the sign of Inl is positive, which increases Iconst for more stability.

(When the temperature falls)

For the term ln (T/Tr) in the above Equation 6, in (T/Tr)<0 because T/Tr<1; so Ivbe increases, and Iconst and Vbe of Q4 also increase accordingly; and a voltage drop occurs across the resistor R2 corresponding to a difference between Vbe of the transistor Q1 and Vbe of the transistor Q2, and flows into the resistor R1 as Inl. Then, the sign of Inl is negative, which reduces Iconst for more stability.

In this way, Inl works to compensate for the nonlinear term of Vbe, thereby reducing to ideally zero the temperature characteristic of the output voltage Vout of the voltage source device for low-voltage operation.

Thus, as shown in FIG. 6, the value of the voltage Vout is within 45 mV relative to a temperature ranging from −40° C. to +80° C., so it can be seen that a voltage source device for low-voltage operation can be implemented with a high degree of accuracy held within 0.86%.

In this case, as a minimum value for its operating voltage, the device is operable as far as the power supply voltage Vcc is greater than the sum of the gate-source voltage Vgs of M1, the base-emitter voltage Vbe of the transistor Q1, and the collector-emitter voltage Vce(sat) of the transistor Q3, i.e., Vgs+Vbe+Vce(sat); for example, assuming that Vgs=1.0 [V], Vbe=0.7 .[V], and Vce(sat) is 0.3 [V], then the device is operable as far as Vcc is greater than 2.0 [V].

In this way, according to the present embodiment, a voltage source device for low-voltage operation with a high degree of accuracy can be implemented relatively easily; in addition, because any output voltage can be obtained by combining the current source circuit and the diffused resistor that forms a voltage, it may be employed for a current-regulated DAC and so forth.

Furthermore, because the current source circuit and the diffused resistor that forms a voltage are of the same type, the present embodiment offers advantages that there is little variation, and, additionally, low-voltage operation can be achieved.

It should be appreciated that in the above embodiments, a BiCMOS circuit that combines both bipolar and MOS transistors is employed, although the MOS transistors may be all substituted by bipolar transistors.

As may be clear from the above description, according to the present invention, because variations in output voltage due to changes in temperature can be minimized, a voltage source device for low-voltage operation with a high degree of accuracy can be implemented easily; additionally, because any output voltage can be obtained by combining the current source circuit and diffused resistor, a desired voltage can be produced.

What is claimed is:

1. A voltage source device for low-voltage operation, comprising:

a current source circuit using a bandgap voltage, said current source circuit having a temperature characteristic of (1/T)–2 (where T is an ambient temperature and a is a constant);

a compensation circuit, having a temperature characteristic including at least a term of –1/T, said compensation circuit compensating for the temperature characteristic of said current source circuit; and a voltage conversion circuit for converting the power supply current provided by said current source circuit into a power supply voltage.

2. A voltage source device for low-voltage operation, comprising:

a current source circuit using a bandgap voltage, said current source circuit having a temperature characteristic of (1/T)–2 (where T is an ambient temperature and a is a constant);

a compensation circuit for compensating for the temperature characteristic of said current source circuit; and a voltage conversion circuit for converting the power supply current provided by said current source circuit into a power supply voltage;

wherein said compensation circuit including:

a pair of first and second transistors, having collector terminals connected to a high-potential power supply line, emitter terminals connected to a low-potential power supply line, and base terminals connected in common;

a third transistor having a base terminal connected to the collector terminal of said first transistor, a collector terminal connected to the collector terminal of said second transistor, and an emitter terminal connected to the base terminals of said first and second transistors connected in common; and a resistor having one end connected to the base terminals of said first and second transistors connected in common, and the other terminal connected to the low-potential power supply line.

3. A voltage source device for low-voltage operation, comprising:

a current source circuit using a bandgap voltage, said current source circuit having a temperature characteristic of (b 1/T)–2 (where T is an ambient temperature and a is a constant);

first and second compensation circuits for compensating for the temperature characteristic of said current source circuit; and a voltage conversion circuit for converting the power supply current provided by said current source circuit into a power supply voltage;

wherein said first compensation circuit including:

a pair of first and second transistors having collector terminals connected to a high-potential power supply line, emitter terminals connected to a low-potential power supply line, and base terminals connected in common;

a third transistor having a base terminal connected to the collector terminal of said first transistor, a collector terminal connected to the collector terminal of said second transistor, and an emitter terminal connected to the base terminals of said first and second transistors connected in common; and a resistor having one end connected to the base terminals of said first and second transistors connected in common, and the other end connected to the low-potential power supply line; and wherein said second compensation circuit including:

a resistor having one end connected to the base terminals of said first and second transistors connected in common;

a fourth transistor having its base and collector terminals connected to the other end of said resistor, and an emitter terminal connected to the low-potential power supply line; and a current supply circuit for supplying a predetermined constant current to the base and collector terminals of said fourth transistor.

* * * * *

UNITED STATES PATENT AND TRADEMARK OFFICE

CERTIFICATE OF CORRECTION

PATENT NO. : 5,675,243

DATED : October 7, 1997

INVENTOR(S) : Takatsugu Kamata

It is certified that error appears in the above-identified patent and that said Letters Patent is hereby corrected as shown below:

In Claim 1, column 9, line 1, delete "(1/T)-2" and insert --(1/T)-a-- therefor.

In Claim 2, column 9, line 14, delete "(1/T)-2" and insert --(1/T)-a-- therefor.

In Claim 3, column 10, line 3, delete "(1/T)-2" and insert --(1/T)-a-- therefor.

Signed and Sealed this

Second Day of June, 1998

*Attest:*

*Attesting Officer*

BRUCE LEHMAN

*Commissioner of Patents and Trademarks*